United States Patent [19]

Barsi et al.

[11] 4,400,035

[45] Aug. 23, 1983

[54] PROCESS FOR THE EXTRACTION OF THICK COAL SEAMS

[75] Inventors: Karoly Barsi; Hugó Salamon; András Solymos; József Takács; István Tóth, all of Tatabanya, Hungary

[73] Assignee: Tatabányai Szénbanyák, Tatabanya, Hungary

[21] Appl. No.: 251,356

[22] Filed: Apr. 6, 1981

[30] Foreign Application Priority Data

Apr. 15, 1980 [HU] Hungary ..... 907/80

[51] Int. Cl.[3] ..... E21C 41/04

[52] U.S. Cl. ..... 299/11; 299/19

[58] Field of Search ..... 299/11, 19; 405/267

[56] References Cited

U.S. PATENT DOCUMENTS

| | | | |
|---|---|---|---|
| 2,846,205 | 8/1958 | Bucky | 299/19 X |
| 3,527,500 | 9/1970 | Thompson | 299/11 |
| 4,174,135 | 11/1979 | Grenia | 299/11 |
| 4,219,237 | 8/1980 | Sisemore | 299/11 X |
| 4,340,254 | 7/1982 | Barsi et al. | 405/267 X |

FOREIGN PATENT DOCUMENTS

| | | |
|---|---|---|
| 153410 | 3/1967 | Hungary . |
| 473829 | 9/1975 | U.S.S.R. . |
| 480846 | 10/1975 | U.S.S.R. . |

*Primary Examiner*—Ernest R. Purser

*Attorney, Agent, or Firm*—Gabriel P. Katona

[57] ABSTRACT

There is disclosed a process for the extraction of thick coal seams by means of which coal seams not extractable in one bank or slice and/or located at peripheral areas may also be extracted under improved mine safety conditions and with high productivity.

According to the invention the thick coal seam is if required, divided horizontally and/or vertically into extraction blocks which are bounded and separated by stowing pillars arranged according to the direction of advance of the extraction. The cavity of the pillars is advanced at a level higher than the level of the roof of the extraction space, after which the cavity of the pillar is back-filled. Then the block is extracted by means of block caving in a manner known per se. In a preferred embodiment of the invention incombustible material that agglomerates under the effect of the static pressure of the rock is used for stowing.

The utilization of the process for extraction according to the invention results in a considerable increase of intensity. Whether the extraction is in one or more slices and whether using individual or self-advancing supports, using track-bound or independent loading/conveyor equipment, an economic extraction of coal seams is achieved.

8 Claims, 1 Drawing Figure

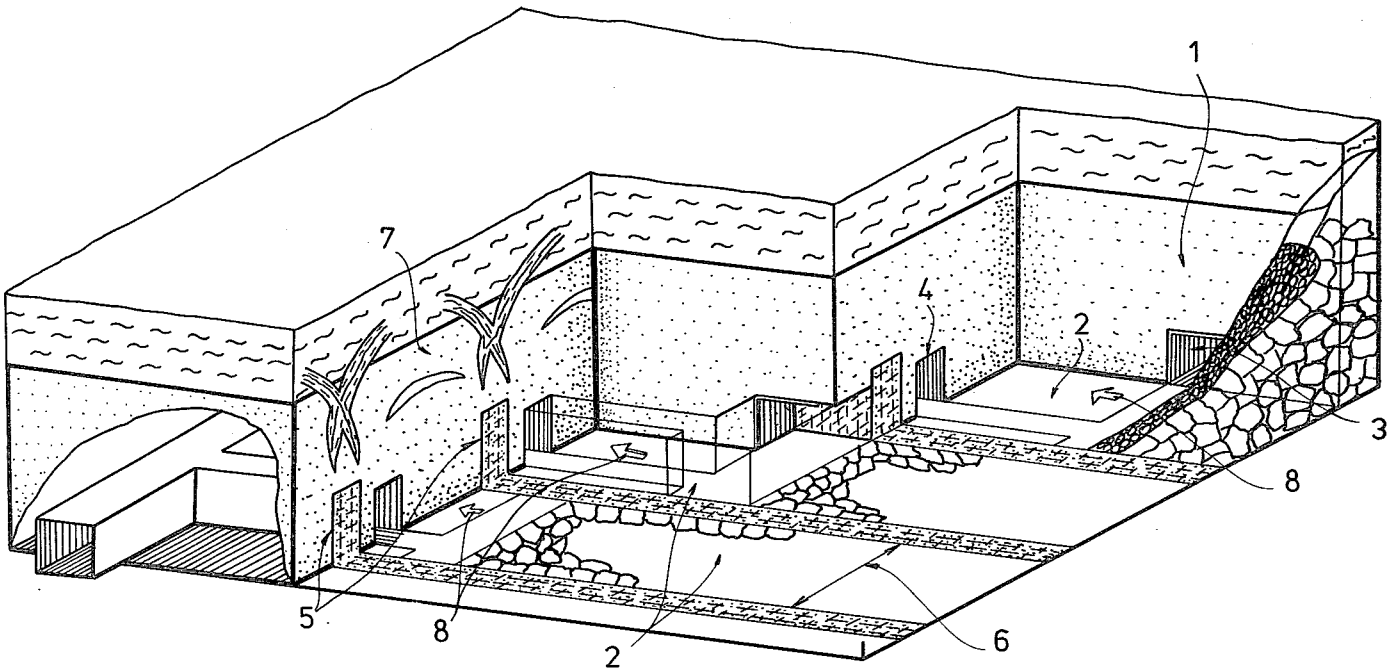
1
2
3
4
5
6
7
8

PROCESS FOR THE EXTRACTION OF THICK COAL SEAMS

BACKGROUND

The invention concerns a process for the extraction of thick coal seams by means of which coal deposits in areas where single-slice (single-back) coal winning is not possible and/or peripheral coal seams can be extracted with high productivity and under improved mine safety conditions.

There are several known technical solutions to the problem of exploitation of coal seams which cannot be extracted in single-section "one-slice" working by the application of hitherto known methods of winning and supporting system, due to geological or other conditions such as previous mining operations, "old-man" (depleted) cavities. Such solutions include inter alia:

(a) Working in an ascending direction at a plurality of slices or sections, while employing stowing. The extracted coal of successive slices advances across the backfilling or stowing of the preceding slices.

(b) Working in a descending direction at a plurality of slices with stowing and/or caving. In the couse of stowing the stowage material, or at least its bottom layer, is stabilized prior to the start of a new slice, or an artificial roof is constructed, or a thin protective layer, and a so-called "coal skin" is left in the roof. In given cases these methods may be combined. If caving is applied, there must be sufficient waiting for the appropriate agglomeration of the goaf (stowage) of the preceding section. If an artificial roof is formed e.g. a net or mesh is laid down before caving is carried out, in the most advanced method, the goaf, or at least the bottom layer thereof is rendered solid. Again, if need be, the known methods are combined. Extraction of the slice situated below the caving can only be commenced under the caving if the goaf has been suitably agglomerated and/or rendered solid.

(c) Also known is a process wherein the thick seam is divided into fewer working slices than the number of slices derived from the practical limit in height at which the winning and support may be used; or it may even be extracted in one slice only by the caving located in the roof of the extraction space. The winning of coal or other useful minerals located in the roof by caving i.e. by block caving (applying the nomenclature used principally in ore mining) can also be carried out by different methods.

(d) In one of the known methods of block caving, the in situ caving of the required quantity of useful minerals at a given time is excited by blasting or by other means. Such a method is described e.g. in Hungarian patent specification No. 153,410 and in Soviet patent specification No. 473,829.

(e) Similarly, caving is provoked and promoted by external intervention, by displacing the rear elements of supporting units of varying systems or by using individual manipulating devices built for that purpose. A technical solution of this type is disclosed, inter alia, in Soviet patent specification No. 480,846.

(f) Block caving combined with the formation of coal pillars (coal ribs) is often applied in random seams cut through by faults and at the periphery of broad or longwall seams employing fully mechanized mining, working as a cleaning-up extraction operation. Except for seams of relatively small dimensions, at such seams a plurality of narrow faced working faces has to be established, in accordance with the prevailing conditions. Between the extraction faces coal pillars (legs) which are left behind, are left temporarily or are frequently permanently left in and are therefore lost, according to the technology applied. This residual coal pillar increases the quantity of lost coal, particularly if it has low strength. However, where in order to reduce the loss, the pillar dimensions are chosen to be smaller, the pillar may crumble and hence cannot perform its function, on the contrary, this significantly increases the fire hazard.

(g) Soviet patent specification No. 473,829 entitled "A METHOD of extraction of THICK SEAMS" describes a method of block caving wherein the winning of coal is carried out by drilling and blasting or by some other mechanical comminution. In order to carry out this process with the requisite safety and control, in the interests of assuring the firmness of the roof pillar, a suitable inclination in the direction of the virgin coal seam must be given to the face of the roof.

According to this Soviet patent specification during the development of the extraction space a pressure zone of high concentration is formed, as a consequence of which it becomes uncontrollable and a breakage (fall) extending over the totality of the thickness of the coal seam can occur.

If, on the other hand, the process according to the Soviet invention is applied, the roof to be extracted by drilling and blasting or by other mechanical means can be relieved from the pressure of the pillar and it will retain its roof strength during the total period of the winning cycle.

Although the known methods are widely used in given circumstances, they cannot meet the complex requirements of highly concentrated production and increased productivity according to modern concepts, combined with the indispensably requisite high degree of mine safety. In any case they all have various drawbacks that cannot be obviated completely but can only be restricted. Such drawbacks include, inter alia:

- They cannot satisfactorily secure safety conditions in the mines and in mining, particularly the prevention of the hazards of falls, gas and fire. This is true e.g. of the less advanced methods of (b), (d), (e), (f) and (g);
- Production can only be performed at low intensity, e.g. certain variants of (a), (b), (d) and (e);
- Poor level of economy, e.g. (a), (d) and (f).
- Their domain of application greatly depends on the dimensions and geological conditions of the seam;
- Generally the given method of extraction prescribes almost compulsorily the application of predetermined supports and extraction machinery;
- Complicated, expensive machinery and technology is required, e.g. certain variants of (b), (d), (e) and (f);

BRIEF DESCRIPTION OF THE INVENTION

The object of this invention is to provide a process which may be widely used even under extreme conditions and circumstances, and by the application of which high productivity and economy can be achieved by not particularly complicated means, accompanied by improved production and working safety as well as a considerable increase of the intensity of production.

According to the invention, this object is achieved in that the thick coal seam is, if required, divided horizontally and/or vertically into extraction blocks which are delineated or bounded by stowing pillars according to the direction of the advance of extraction. The cavity of the pillar is advanced and stowed at a level higher than the roof of the extraction space formed at the bottom of the extraction block and is filled in with stowage material, whereafter the block is extracted in a known manner by block caving.

In one of the preferred embodiments, the stowing pillars are interspaced at a distance which is at most seven times, preferably 3–5 times larger than the width of the pillars. The width of pillars is 2–5 m, preferably 2.5–3.5 m and their height is larger than the level of the roof of the extraction space by at least 0.5 to 1.5 m. The profile of the pillar is advantageously quadrangular.

In another preferred embodiment of the invention an incombustible stowage material that agglomerates under the effect of the geostatic pressure is used for stowing the pillars.

In a further preferred embodiment, the caving of the block is assisted by a "provocative" method (blasting).

The fundamental idea of the invention is based on the fact that in general, but particularly in the case of the principal field of applicability of the invention, namely in narrow face working, the contact between the actual operation area and the already completed extraction area causes special problems. Should the winning directly touch the caving over a bank work which has not quite agglomerated and which possibly protrudes over the neighbouring advancing extraction, an unstable state of equilibrium can occur, particularly above the support means of the peripheral areas facing the already extracted space, thus creating a direct danger of breakage or fall for the actually operating extraction space.

At the boundaries of the loose, friable goaf, particularly in corners formed by the floor of the caving and the existing coal pillar, a tentshaped cavity is formed which may draw away the air from the contiguous spaces, thus creating a fire hazard. If the fall contains dangerous gases (CO, $CH_4$, etc) direct winning onto the caving may enable these gases to enter and endanger the open spaces.

To avoid the hazards of falling ground, gas and fire coming from the direction of the extracted area, a longer time would be desirable to await agglomeration of the loose goaf. But then it is impossible simultaneously to settle on a plurality of working places, hence the process of extraction would become protracted and no satisfactory intensity of production can be achieved. This poses a particular problem if the area to be stripped by block caving is situated behind larger areas extractable by longwall face working, when the longwall face working cannot be started without the area to be stripped being clogged.

The invention is thus based on the recognition or idea of separating the extraction blocks by stowing pillars. These initially open and subsequently filled-in pillars change the original state of equilibrium and stress conditions of the coal seam. The change in stress causes deformation. The movements deriving from the deformation are not hindered but rather are made possible by the yieldable nature of the stowage pillars. As a consequence of the movements, a new rearrangement in stress and further deformations occur and finally a new state of equilibrium is formed.

One of the direct results of this sequence of events is that the agglomerated pillars block the air paths that in view of fire hazard are very dangerous and thus prevent escapes of gas and draughts.

From the point of view of safety and the mechanics or rock movements, it is important that the coal lying on top of the stowage pillars should in practice remain rigid even though it is of reduced rigidity, due to the rock movements and there is no unstable equilibrium above the supporting units disposed at the periphery of the extraction space, on the side of the already extracted area.

It is very important part of the basic idea of the process that the sequence of rock movements and agglomerations caused by the stowing pillar creates a very advantageous rearrangement of stress in the neighbourhood of the stowed cavity, which in general provokes the spontaneous breakage or fall of the useful mineral thus enabling the extraction of the material without the need for a specific intervention or measure.

BRIEF DESCRIPTION OF THE DRAWINGS

The invention is illustrated by the accompanying schematic drawing showing a thick coal seam extractable by means of block caving.

DETAILED DESCRIPTION OF THE INVENTION

With reference to the drawing it shows a thick coal seam 1 of extractable by means of block caving which has been divided horizontally into expediently rectangular section extraction blocks 2. One side of the rectangle determines the width, the other side the running length of the extraction. In the longitudinal direction of the extraction blocks 2, i.e. corresponding to the direction of the advance of winning, a road or drift is driven at a height which is higher than the level of the roof 4 of the extraction space 3, formed at the bottom of the block, while the coal that is present there is extracted. This cavity is back-filled whereby an artificial stowing pillar 5 is formed within the coal seam for the separation of the individual extraction blocks.

These cavities act as stowing pillars while they are still open, and when subsequently filled in, these cavities act as stowing pillars and change the original state of equilibrium and stress of the surrounding coal.

The magnitude of the distance 6 between the stowing pillars 5 depends, inter alia, on the strength of rigidity of the coal to be caved and on other geological and possible previous mining conditions. In any case, the distance 6 has to be chosen in such a way that the stress zones created by the stowing pillars 5 should be in contact with one another to such an extent and in such a manner that the coal stratum is sufficiently weakened during the rearrangement of the stress. In this kind of settlement, the coal 7 of reduced rigidity can be extracted by direct caving onto a scraper (drag) type conveyor and system, and if required, may also be won by blasting.

To ensure that the stowing pillar 5 will perform the required rock mechanical and separating functions, it should be formed well before the extraction.

The arrows 8, in the drawing, point towards the direction of advance of the extraction.

The working out of the coal seam can be carried out in one or more slices or banks, depending upon the thickness of the seam. The most favourable thickness of the roof coal, according to practical experience is 8–12 m.

As illustrated in the drawing, the extractions may, after proper preparation, also be settled in groups. The underground transport of the extracted coal by means of an extraction and haulage road system being shown only diagrammatically in the drawing but is not specifically referred to.

The advantages of the process according to the invention are as follows:

1. The stowing pillars provide very good sealing off and separation between the individual extraction blocks and goaf of the extraction, even where their width is relatively small e.g. 3–4 m. The pillar consisting of incombustible and agglomerated material blocks the loose goaf located on one side of the pillar from the open mining space situated on the other side of the pillar, therefore no air communication between the two sides can occur.

2. Due to the separation of the extraction blocks by the pillar, the process is also suitable for the extraction of coal seams that are prone to intensive escapement of $CH_4$ gas and with a tendency to endogenous fires.

3. The sealing/separating effect of the stowing pillar can be utilised also for longwall faces. Generally the stowing pillar is suitable for sealing off and separating any kind of mining operation accompanied by potential fire hazards.

4. The process can be applied to the extraction of coal seams of arbitrary thickness and stratogeographical conditions.

5. Application of the process enables a rapid extraction of coal fields which, due to their shape, size, geological or otherwise disturbed bedding, cannot be extracted by fully mechanized longwall face working systems. The quick and economical extraction makes it possible that the fields of various dimensions and of quasi-triangular or irregular shape remaining along the fault line of the longwall face can be extracted by direct preparation such as conveying, ventilation, power supply and the like, of the longwall face working system. Without the extraction of these remaining blocks, the front cannot start because otherwise the fields would be blocked and their re-developing would be very expensive.

6. By the application of the process, extractions of high concentrations can be achieved. Therefore, the process can also be used for stripping/extraction of small fields or as an independent extraction system for larger fields. It is also possible to settle on narrow face working systems in groups, wherein within the respective field, the individual extractions are relatively closely located to one another without hazards in respect of time and place, whereby the quick working out of the coal field is made possible.

7. The obviation of the need to dress each bank or slice is economical and enables the efficiency of extraction to approximate the efficiency of a longwall working system. The process can also be used in thin seams which can be extracted by one-slice or single bank preparation.

8. There is no need to leave behind coal pillars (ribs) amongst the extraction blocks, and therefore, besides achieving considerable improvement in mining safety, coal losses are also reduced.

9. The process for extraction according to the invention can be applied not only for extraction with individually settled on supports, but also for extractions with self-advancing support systems.

10. The process permits the use of continuous underground conveying systems, with winning/loading machines directly coupled to them as well as loading/conveying equipment not tied to rail vehicles. Since such equipment is remotely controllable, the use of such systems is particularly favourable in the caving phase of the work.

The invention is not restricted to the embodiments of extraction systems described merely by way of example. Within the scope of the claims it may also be applied to numerous other extraction systems as required by prevailing conditions or prescriptions.

What is claimed is:

1. A process for the extraction of thick coal seams which are divided into extraction blocks, horizontally and/or vertically, comprising bounding each of the extraction blocks by a stowing pillar so no air circulates between the extraction blocks, said pillars being interspaced at a distance wherein stress zones created thereby are in contact with one another, and said pillars are set up according to the direction of advance of extraction by advancing the cavity of the stowing pillar having a roof level within the coal seam which is higher than the level of the roof of the extraction space which is formed at the bottom of the extraction block, backfilling the cavity and then extracting the block by block caving.

2. A process according to claim 1, wherein the stowing pillars are interspaced at a distance no greater than 1 times the length of their width.

3. A process according to claim 2, wherein the stowing pillars are interspaced at a distance of from about 3 to 5 times the length of their width.

4. A process according to claim 1, wherein the width of the stowing pillars is from about 2 to 5 meters and their height is about 0.5 to 1.5 meters higher than the level of the roof of the extraction space.

5. A process according to claim 4, wherein the width of the stowing pillars is from about 2.5 to 3.5 meters.

6. A process according to claim 1, wherein the cavity of the stowing pillars is advanced with a rectangular profile.

7. A process according to claim 1, wherein the stowing pillar is comprised of an incombustible material that agglomerates under the effect of the static pressure of the rock in said extraction blocks.

8. A process according to claim 1, wherein the caving of the block is assisted by shock blasting.

* * * * *